US005084950A

United States Patent [19]

Okuda

[11] Patent Number: 5,084,950

[45] Date of Patent: Feb. 4, 1992

[54] THREAD DRAWING-IN HEAD WITH CLAMP FOR DRAWING DEVICE

[75] Inventor: Tetsuo Okuda, Gifu, Japan

[73] Assignee: CKD Corporation, Aichi, Japan

[21] Appl. No.: 617,890

[22] Filed: Nov. 26, 1990

[30] Foreign Application Priority Data

Nov. 24, 1989 [JP] Japan ..... 1-305765

[51] Int. Cl.[5] ..... D03J 1/14

[52] U.S. Cl. ..... 28/205; 28/203.1; 28/204; 28/206

[58] Field of Search ..... 28/203, 205, 206, 207, 28/204

[56] References Cited

U.S. PATENT DOCUMENTS

| | | | |
|---|---|---|---|
| 4,047,270 | 9/1977 | John | 28/205 |
| 4,499,638 | 2/1985 | Heinz | 28/207 |
| 4,525,906 | 7/1985 | Tovenrath | 28/205 |
| 4,815,498 | 3/1989 | Gryson et al. | 28/207 X |
| 4,894,893 | 1/1990 | Okuda | 28/204 |

FOREIGN PATENT DOCUMENTS

| | | |
|---|---|---|
| 50-20067 | 3/1975 | Japan . |
| 62-289654 | 12/1987 | Japan . |
| 63-295744 | 12/1988 | Japan . |
| 63-315645 | 12/1988 | Japan . |
| 64-20360 | 1/1989 | Japan . |
| 1-298254 | 12/1989 | Japan . |

OTHER PUBLICATIONS

0298696; 1-1989; European Patent Application; Juro.

*Primary Examiner*—Andrew M. Falik
*Assistant Examiner*—Bibhu Mohanty
*Attorney, Agent, or Firm*—Wenderoth, Lind & Ponack

[57] ABSTRACT

A thread drawing-in head for a drawing device in which at least two heads, each having a warp thread guide passage, are disposed in series such that the passages can align in series, to clamp a heald therebetween in such a manner that a hole of the heald is aligned with the passages. Each thread drawing-in head comprises a first portion having a groove that defines the passage, the groove extending therethrough longitudinally, the first portion being rotatably supported, a second portion that is supported in such a manner as to be movable toward and away from the first portion to close and open the groove and rotatable together with the first portion, a guide groove that is formed at one end of the head that is comprised of the first and second portions, the guide groove being defined by a bottom surface that extends substantially perpendicularly to the groove to engage with a surface of a heald to be clamped and a slanted surface that extends divergently from each end of the bottom surface, and a projection that is formed at the other end of the head, the projection having a top surface that engages with the surface of a heald to be clamped and a slanted surface that extends from each end of the top surface so that the projection fits into the guide groove of another head.

9 Claims, 5 Drawing Sheets

THREAD DRAWING-IN HEAD WITH CLAMP FOR DRAWING DEVICE

FIELD OF THE INVENTION

The present invention relates to a thread drawing-in head for use in a drawing device for drawing warp threads into healds in a preparatory step for weaving. The present invention also relates to a method of clamping a heald by using this thread drawing-in head.

BACKGROUND OF THE INVENTION

One type of conventional drawing device is designed to draw a warp thread into a hole of each heald by utilizing an air jet. For example, see Japanese Patent Application No. 63-128071 (1988) entitled Drawing Device, filed by the applicant of the present invention. In this device, a heald is disposed between a pair of adjacent thread drawing-in heads arranged in series, and a hole of the heald through which a thread is inserted is aligned with air jet passages that are formed in the heads. Thereafter, air is blown into the series of air jet passages from one end of the row of heads to blow a warp thread into the passages by means of the air stream, thereby drawing the thread into the hole of the heald.

Incidentally, there are two different types of heald, that is, the simplex type in which the hole is substantially on the center line that intersects the centers of guide holes which are provided at two ends of the heald, and the duplex type in which the hole is offset from the center line that intersects the centers of guide holes at two ends of the heald. When warp threads are to be drawn into healds of the latter type, the healds are supported by a guide rod with the direction of the healds being alternately changed so that the holes are alternately disposed on the two sides of the center line.

The above-described drawing device, which has been filed by the present applicant, is, however, adapted to draw warp threads into simplex healds and is therefore unsuitable for duplex healds in which the hole is offset from the center line.

SUMMARY OF THE INVENTION

It is a principal object of the present invention to provide a novel thread drawing-in head for a drawing device, which is capable of drawing a warp thread into not only a simplex heald but also a duplex heald, by improving the structure of the conventional thread drawing-in head.

It is another object of the present invention to provide a method of clamping a heald by using the above-described thread drawing-in head.

To attain the first object, the present invention provides a thread drawing-in head for a drawing device in which at least two heads, each having a warp thread guide passage, are disposed in series such that the passages can be aligned in series, to clamp a heald therebetween in such a manner that a hole of the heald is aligned with the passages, wherein the improvement comprises: a first portion having a groove that defines the passage, the groove extending therethrough longitudinally, the first portion being rotatably supported; a second portion that is supported in such a manner as to be movable toward and away from the first portion to close and open the groove and rotatable together with the first portion; a guide groove that is formed at one end of the head that is comprised of the first and second portions, the guide groove being defined by a bottom surface that extends substantially perpendicularly to the groove to engage with a surface of a heald to be clamped and a slanted surface that extends divergently from each end of the bottom surface; and a projection that is formed at the other end of the head, the projection having a top surface that engages with a surface of a heald to be clamped and a slanted surface that extends from each end of the top surface so that the projection fits into the guide groove of another head.

To attain the second object, the present invention provides a method of clamping a heald by thread drawing-in heads each including a first portion having a groove that defines a warp thread guide passage, the groove extending therethrough longitudinally, the first portion being rotatably supported, a second portion that is supported in such a manner as to be movable toward and away from the first portion to close and open the groove and rotatable together with the first portion, a guide groove that is formed at one end of the head that is comprised of the first and second portions, the guide groove being defined by a bottom surface that extends substantially perpendicularly to the groove to engage with a surface of a heald to be clamped and a slanted surface that extends divergently from each end of the bottom surface, and a projection that is formed at the other end of the head, the projection having a top surface that engages with a surface of a heald to be clamped and a slanted surface that extends from each end of the top surface so that the projection fits into the guide groove of another head, wherein the improvement comprises disposing a pair of heads of the type described above at both sides, respectively, of a row of healds to be clamped, with the axis of rotation of the heads being parallel to the row of healds and with the guide grooves and the projections facing vertically so that a heald can enter the gap between the heads, and rotating the heads about 90° to receive the heald in the guide groove of one of the heads and push the heald into the guide groove by the projection of the other head, thereby twisting a clamp surface of the heald through a desired angle as well as preventing air from leaking to the outside.

A pair of heads having the above-described arrangement are disposed at both sides, respectively, of a row of healds to be clamped, with the axis of rotation of the heads being parallel to the row of healds and with the guide grooves and the projections facing vertically so that a heald can enter the gap between the heads. When the heads, which are in this state, are rotated about 90°, the heald is received in the guide groove of one of the heads and pushed into the guide groove by the projection of the other head. In consequence, the surfaces of the heald which are to be clamped are held between the bottom surface of the guide groove and the top surface of the projection. Thereafter, air is passed through the passages in the heads to draw a thread into the hole of the heald by means of the air stream.

DETAILED DESCRIPTION OF PREFERRED EMBODIMENT

One embodiment of the present invention will be described below with reference to the accompanying drawings.

Figure 1:
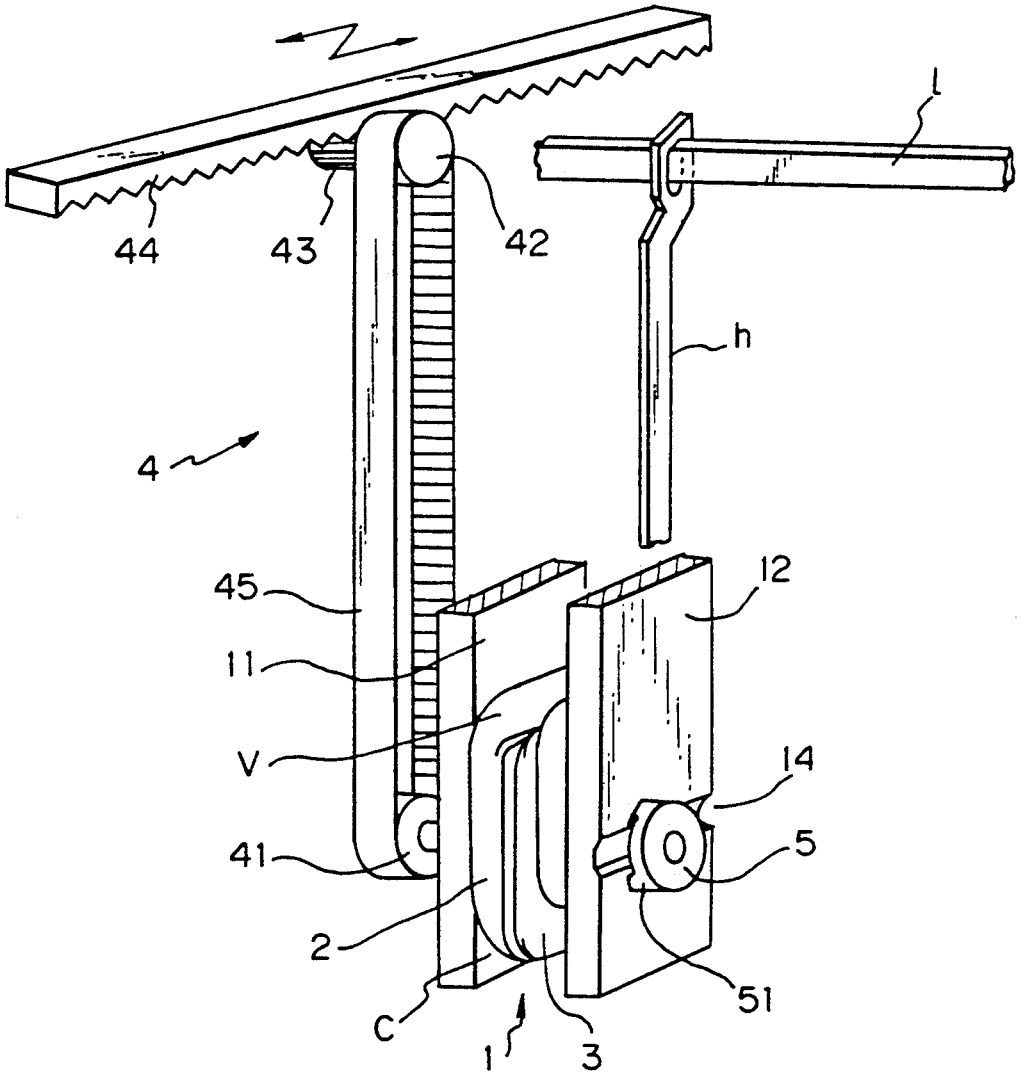
FIG. 1 is a perspective view of one embodiment of the thread drawing-in head according to the present invention.
Figure 2:
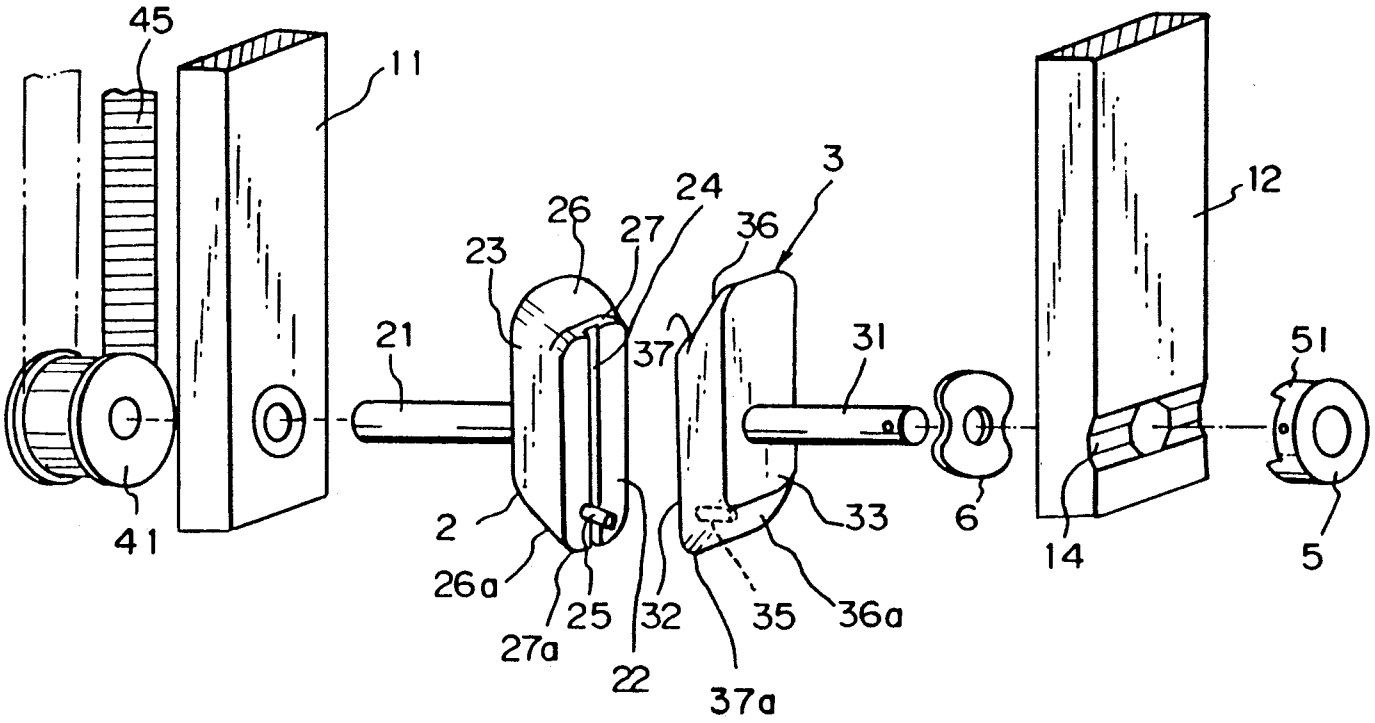
FIG. 2 is an exploded perspective view of the thread drawing-in head shown in FIG. 1.
Figure 3:
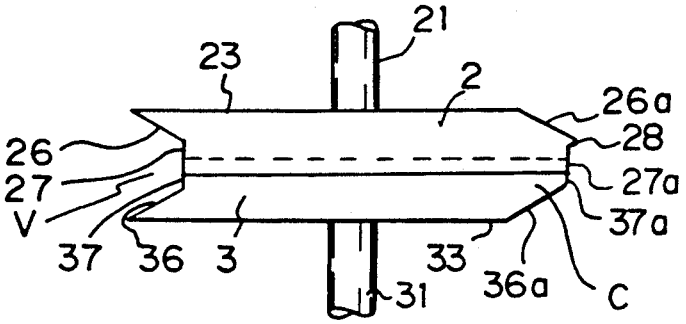
FIG. 3 is a top plan view of the thread drawing-in head.

FIGS. 1 to 3 show a thread drawing-in head 1 according to this embodiment. The thread drawing-in head (hereinafter referred to as simply "head") 1 has a first portion 2 and a second portion 3, which are relatively thin and substantially rectangular. The first and second portions 2 and 3 have respective front surfaces 22 and 32, which face each other, and rear surfaces 23 and 33, which are reverse with respect to the front surfaces 22 and 32. Shafts 21 and 31 are secured to substantially central portions of the rear surfaces 23 and 33, respectively, the shafts 21 and 31 extending perpendicularly to the respective surfaces 23 and 33. The shafts 21 and 31 are rotatably supported by a pair of spaced bearing plates 11 and 12, respectively, of a drawing device. The front surface 22 of the first portion 2 is formed with a groove 24 that extends longitudinally through the substantially central portion thereof. The front surface 22 of the first portion 2 further has a connecting pin 25 that is vertically secured to a position which is at one side of the groove 24 and off the center of rotation. The front surface 32 of the second portion 3 has a small hole 35 that is formed at a position where the hole 35 coincides with the connecting pin 25 to receive it when the first and second portions 2 and 3 are laid on top of each other. The shafts 21 and 31 are concentric with respect to each other. The shaft 21 is capable of rotation only, whereas the shaft 31 is capable of both rotation and axial movement.

The first portion 2 of the thread drawing-in head 1 has a slanted inner surface 26 that is formed at one end thereof where the groove 24 is open (i.e., at the right-hand side as viewed in FIG. 2), and a bottom surface 27 that is contiguous with the slanted inner surface 26. The first portion 2 further has a slanted outer surface 26*a* that is formed at the other end, the slanted outer surface 26*a* being coincident with the slanted inner surface 26, and a top surface 27*a* that is adjacent to the slanted outer surface 26*a*. At the boundary between the slanted outer surface 26*a* and the top surface 27*a* is formed a stopper projection 28 that has a height which is smaller than the thickness of a heald. The second portion 3 also has a slanted inner surface 36 that is formed at an end thereof which is matched with the one end of the first portion 2 when the first and second portions 2 and 3 are connected together by the connecting pin 25, and a bottom surface 37 that is contiguous with the slanted inner surface 36. The second portion 3 further has at the other end thereof a slanted outer surface 36*a* that is coincident with the slanted inner surface 36 and a top surface 37*a* that is contiguous with the slanted outer surface 36*a*. The slanted inner surfaces 26, 36 and the bottom surfaces 27, 37 define a guide groove V for receiving a heald, whereas the slanted outer surfaces 26*a*, 36*a* and the top surfaces 27*a*, 37*a* define a projection C that enters the guide groove V of another head 1 to press the heald against the bottom of the guide groove V.

Figure 4A:
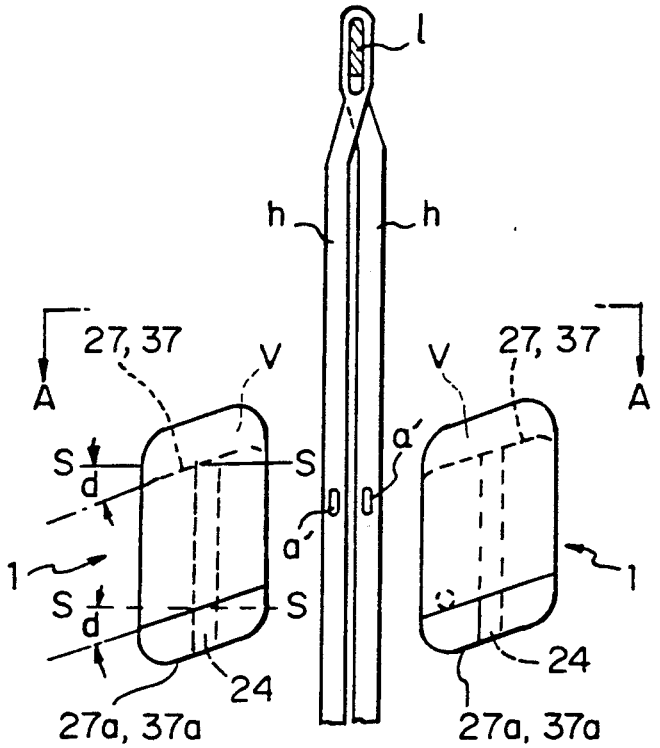
Figure 4B:
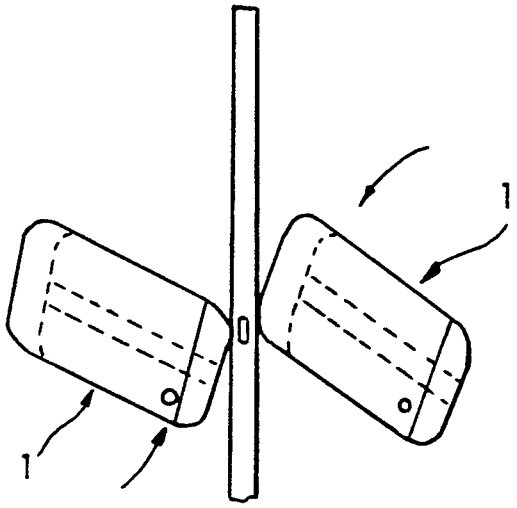

As will be clear from FIG. 4, each of the bottom surfaces 27, 37 and the top surfaces 27*a*, 37*a* is preferably inclined at an angle $\alpha$ with respect to a plane S which is perpendicular to the longitudinal direction of the groove 24 that defines a passage.

The shaft 21 is rotated back and forth through about 90° by a driving mechanism 4. The driving mechanism 4 comprises a timing belt pulley 41 that is secured to the distal end of the shaft 21, a timing belt pulley 42 that is rotatably supported in parallel to the shaft 21 by a known method, a pinion 43 that is attached to the pulley 42, a rack 44 that is in mesh with the pinion 43, and a timing belt 45 that is passed over the two pulleys 41 and 42.

The shaft 31 has a cam 5 that is secured to the distal end thereof. The cam 5 has a pair of trapezoidal projections 51 that extend toward the bearing plate 12, the projections 51 being provided at diametrically symmetric positions. The projections 51 are adapted to engage with a horizontally extending groove 14 that is formed in the surface of the bearing plate 12, the groove 14 having a trapezoidal sectional configuration. A leaf spring (or coil spring) 6 is provided in between the second portion 3 of the head 1 and the bearing plate 12. The leaf spring 6 resiliently presses the second portion 3 toward the first portion 2. Accordingly, when the head 1 is disposed with the guide groove V facing upward and the pair of projections 51 of the cam 5 are disposed in series vertically, the projections 51 abut against the surface of the bearing plate 12, causing the leaf spring 6 to be compressed. As a result, the second portion 3 comes away from the first portion 2 (however, the distal end of the connecting 25 is still located within the small hole 35). When the head 1 is rotated about 90° from the above-described position and consequently the guide groove V faces sideward, the projections 51 of the cam 5 enter the groove 14, so that the second portion 3 moves toward the first portion 2, resulting in their front surfaces 22 and 32 coming into close contact with each other.

A pair of heads 1 having the above-described arrangement are disposed on both sides, respectively, of a row of healds h that are suspended from a rod l, as shown in FIGS. 4 and 5, the healds h being disposed so as to alternately project to two sides of the rod l, as shown in FIG. 4(A), and the heads 1 being disposed in such a manner that the axis of rotation of each head 1 is parallel to the rod l. It should be noted, when a plurality of rows of healds h are disposed, one head 1 is disposed between each pair of adjacent rows of healds h. The vertical position of each head 1 relative to the healds h is set such that, when extending horizontally, the groove 24 of the head 1 aligns with the hole a or a' of a heald h.

Figure 5A:
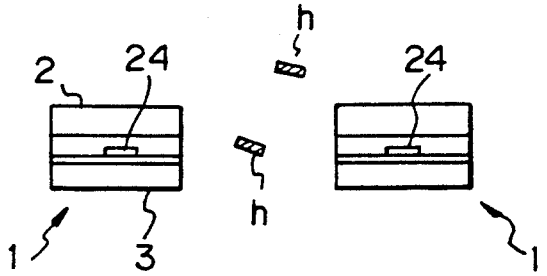
FIGS. 4 and 5 show the operation of a pair of thread drawing-in heads.
Figure 5B:
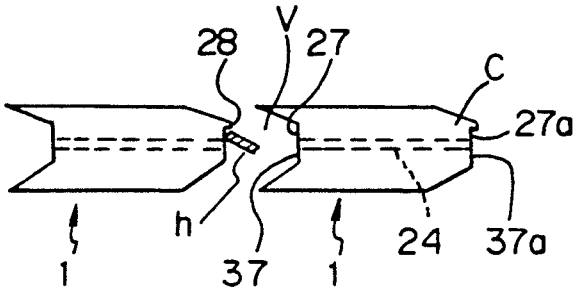
Figure 5C:
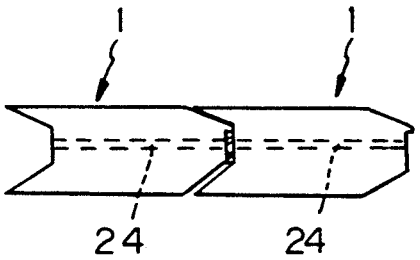
Figure 4C:
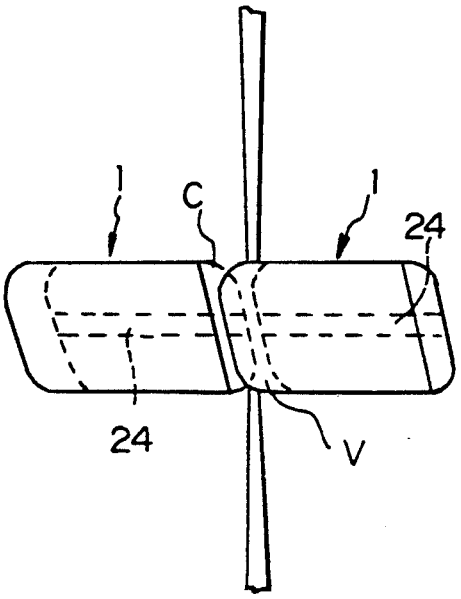

In a device having the above-described arrangement, the heads 1 on both sides of the row of healds h stand by with the guide grooves V facing upward, as shown in FIG. 4(A). In this state, the front one of the healds h that are suspended from the rod l is fed alone into the area between the heads 1. Then, each head 1 is rotated counter-clockwise (as viewed in FIG. 4) by the driving mechanism 4, so that the heald h is pushed into the guide groove V in the right-hand head 1 by the projection C of the left-hand head 1. When each head 1 has rotated 90° from the initial position, the heald h is clamped between the two heads 1, as shown in FIGS. 4(C) and 5(C). In this process, the heald h is substantially parallel to the heads 1 at the beginning, as shown in FIG. 5(A), but, when the heald h comes into contact with one head (i.e., the left-hand head as viewed in FIG. 4) 1 as the heads 1 rotate, the heald h begins to twist, as shown in FIG. 5(B), and when the heads 1 have rotated 90°, the heald h is clamped between the bottom surfaces 27 and 37, which define the guide groove V, and the top surfaces 27*a* and 37*a*, which define the projection C. One edge of the heald h abuts against the stopper projection 28, thus the heald h being positioned. When the heads 1 are suspended after rotating 90°, passages that are defined by the respective grooves 24 in the two heads 1 align with each other in a straight line and these passages align with the hole a or a' of the heald h. In this state, a thread, together with air, is blown into the series of passages from a nozzle (not shown) having a known structure, which is provided at one end of the row of heads 1, for example, at the right-hand end as viewed in FIG. 5(C), thus the thread being drawn into the hole a or a'. After the thread has been drawn into the hole a or a', each head 1 is rotated 90° in reverse to return to the position that is shown in FIG. 4(A). In consequence, the projections 51 of the cam 5 come out of the groove 14, causing the second portion 3 to move slightly away from the first portion 2. Accordingly, the thread comes out of the groove 24 through the gap between the two portions 2 and 3.

Figure 6:
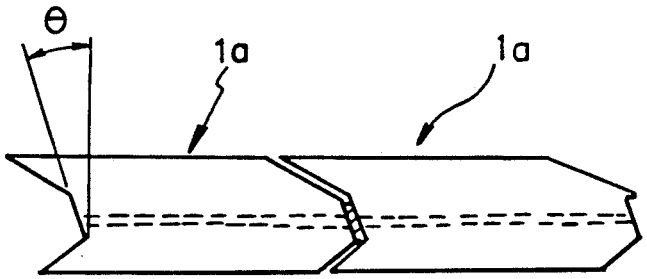
FIG. 6 shows a modification of the thread drawing-in head.

It should be noted that the corners of each head 1 are rounded off, as shown in FIG. 4, so that the head 1 can rotate smoothly in contact with heald h. Although in the above-described embodiment the bottom surface of the guide groove V and the top surface of the projection C are each substantially perpendicular to the groove 24, if this arrangement is unfavorable because the heald h is excessively twisted, the angle $\theta$ of each of the bottom and top surfaces may be changed as desired as in heads 1a that are shown in FIG. 6. More specifically, each of the bottom and top surfaces may be inclined at a desired angle $\theta$ with respect to a plane that is perpendicular to the front surface 22 (32) of each portion 2 (3).

Figure 7A:
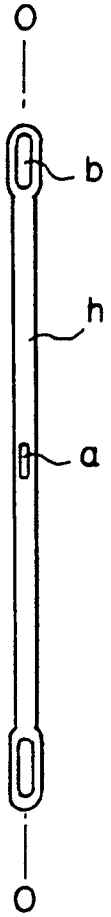
FIG. 7 shows two different types of heald.
Figure 7B:
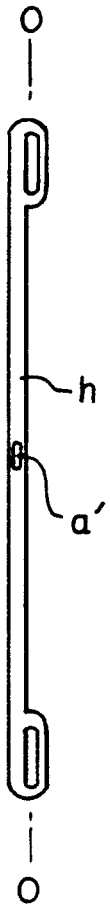

As has already been described, there are two different types of heald h, that is, the simplex type in which the hole a is substantially on the center line O—O that intersects the centers of guide holes b which are provided at two ends of the heald h, as shown in FIG. 7(A), and the duplex type in which the hole a' is offset from the center line O—O that intersects the centers of guide holes b at two ends of the heald h, as shown in FIG. 7(B). When warp threads are to be drawn into healds h of the latter type, the healds h are supported by a guide rod with the direction of the healds h being alternately changed so that the holes a' are alternately disposed on the two sides of the center line O—O.

The present invention provides the following advantageous effects:

(1) The present invention can be applied to either of the simplex and duplex types of heald.

(2) Since the clamping is effected by the cooperation of the guide groove and the projection, misalignment is minimized and the air sealing is facilitated.

(3) The angle of twist of healds can be set as desired by selecting the desired angle of the bottom surface of the guide groove.

What is claimed is:

1. A thread drawing-in head for a drawing device in which at least two heads, each having a warp thread guide passage, are disposed in series such that said passages can be aligned in series, to clamp a heald therebetween in such a manner that a hole of said heald through which a thread is inserted aligns with said passages, wherein the improvement comprises: each head having a first portion having a warp thread groove that defines said passage, said warp thread groove extending therethrough longitudinally, said first portion being rotatably supported; and each head further having a second portion that is supported in such a manner as to be movable toward and away from said warp thread first portion to close and open said groove and rotatable together with said first portion; a heald guide groove that is formed at one end of said head that is comprised of said heald first and second portions, said guide groove being defined by a bottom surface that extends substantially perpendicularly to said warp thread groove to engage with a surface of a heald to be clamped and a slanted surface that extends divergently from each end of said bottom surface; and a projection that is formed at the other end of said head, said projection having a top surface that engages with a surface of a heald to be clamped and a slanted surface that extends from each end of said top surface so that said projection fits into said heald guide groove of another head.

2. A thread drawing-in head according to claim 1, wherein said first and second portions are rotatably supported by respective bearing plates such that said portions can rotate about the same axis, one of said portions having a connecting member that is secured thereto at a position which is offset from said axis, and the other of said portions being formed with a hole that receives said connecting member.

3. A thread drawing-in head according to claim 2, wherein said first and second portions have shafts secured thereto, respectively, said shafts being rotatably supported by said bearing plates, one of said shafts being rotated back and forth by a driving mechanism.

4. A thread drawing-in head according to claim 3, wherein one of said shafts has a cam member secured thereto, said cam member having a further projection that is engageable with a groove that is formed in said bearing plate associated therewith one of said shafts either one of said first and second portions that is secured to said second shaft being resiliently pressed by a spring toward the other of said first and second portions that is secured to said first shaft, so that said portion that is secured to said second shaft moves toward and away from said portion that is secured to said first shaft in accordance with the engagement and disengagement of said further groove and said projection, which are caused by the rotation of said shafts.

5. A thread drawing-in head according to claim 1, wherein at least a portion of each of said bottom and top surfaces of said head is inclined with respect to a plane which is perpendicular to the longitudinal direction of said passage.

6. A method of clamping a heald by a pair of thread drawing-in heads each including a warp thread first portion having a groove that defines a warp thread guide passage, said warp thread groove extending therethrough longitudinally, said first portion being rotatably supported, each head including a second portion that is supported in such a manner as to be movable toward and away from said first portion to close and open said groove and rotatable together with said first portion, a heald guide groove that is formed at one end of each head that is comprised of said first and second portions, said heald guide groove being defined by a bottom surface that extends substantially perpendicularly to said warp thread groove to engage with a surface of a heald to be clamped and a slanted surface that extends divergently from each end of said bottom surface, and a projection that is formed at the other end of said head, said projection having a top surface that engages with a surface of a heald to be clamped and a slanted surface that extends from each end of said top surface so that said projection fits into said heald guide groove of another head, said method disposing said pair of heads at both sides, respectively, of a row of healds to be clamped, with the axis of rotation of said heads being parallel to said row of healds and with said heald guide grooves and said projections facing vertically so that a heald can enter the gap between said heads, and rotating said heads about 90° to receive said heald in said heald guide groove of one of said heads and push said heald into said heald guide groove by said projection of the other head, thereby twisting a clamp surface of said heald through a desired angle.

7. A thread drawing-in head according to claim 2, wherein each of said bottom and top surfaces of said head is inclined with respect to a plane which is perpendicular to the longitudinal direction of said passage.

8. A thread drawing-in head according to claim 3, wherein each of said bottom and top surfaces of said head is inclined with respect to a plane which is perpendicular to the longitudinal direction of said passage.

9. A thread drawing-in head according to claim 4, wherein each of said bottom and top surfaces of said head is inclined with respect to a plane which is perpendicular to the longitudinal direction of said passage.

* * * * *